US009158268B2

(12) United States Patent
Sayama

(10) Patent No.: US 9,158,268 B2
(45) Date of Patent: Oct. 13, 2015

(54) FULLNESS DETECTION DEVICE, IMAGE FORMING APPARATUS, AND METHOD FOR CONTROLLING FULLNESS DETECTION DEVICE

(71) Applicant: KYOCERA Document Solutions Inc., Osaka-shi, Osaka (JP)

(72) Inventor: Haruki Sayama, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 4 days.

(21) Appl. No.: 14/057,791

(22) Filed: Oct. 18, 2013

(65) Prior Publication Data

US 2014/0112673 A1 Apr. 24, 2014

(30) Foreign Application Priority Data

Oct. 19, 2012 (JP) ..... 2012-232201

(51) Int. Cl.
*G03G 21/12* (2006.01)

(52) U.S. Cl.
CPC ..... *G03G 21/12* (2013.01); *G03G 2215/0894* (2013.01)

(58) Field of Classification Search
CPC ..... G03G 2215/0894; G03G 2215/0897; G03G 21/12
USPC ..... 399/35
See application file for complete search history.

(56) References Cited

U.S. PATENT DOCUMENTS

2010/0074644 A1* 3/2010 Kyung ..... 399/71
2010/0080603 A1* 4/2010 Takahashi ..... 399/72
2011/0128305 A1* 6/2011 Shimizu ..... 345/690

FOREIGN PATENT DOCUMENTS

JP 56164353 A * 12/1981 ..... G03G 15/00
JP 2005-024949 A 1/2005

OTHER PUBLICATIONS

English Abstract and Machine Translation for JP 2005-024949, published Jan. 27, 2005.

* cited by examiner

*Primary Examiner* — David Gray
*Assistant Examiner* — Sevan A Aydin
(74) *Attorney, Agent, or Firm* — NDQ&M Watchstone LLP

(57) ABSTRACT

A fullness detection device includes a waste toner collecting portion, a waste toner container configured to store the collected waste toner, the waste toner container has translucency, a detecting portion including a light emitting portion and a light receiving portion disposed to sandwich the waste toner container, the light receiving portion receiving the light from the light emitting portion, and a determining portion configured to determine whether or not the waste toner container is full based on whether or not an output value of the light receiving portion is higher than a predetermined threshold value. The light emitting portion increases light intensity step by step and emits light at a level of smallest light intensity among light intensity levels at which it is determined that the waste toner container is not full.

13 Claims, 8 Drawing Sheets

FULLNESS DETECTION DEVICE, IMAGE FORMING APPARATUS, AND METHOD FOR CONTROLLING FULLNESS DETECTION DEVICE

CROSS-REFERENCE TO RELATED APPLICATIONS

This application is based on and claims the benefit of priority from the corresponding Japanese Patent Application No. 2012-232201 filed on Oct. 19, 2012, the entire contents of which are hereby incorporated by reference.

BACKGROUND

The present disclosure relates to collection of waste toner in an image forming apparatus that performs printing using toner. In particular, the present disclosure relates to a fullness of a waste toner container detection device for a waste toner collection container.

In general, an image forming apparatus (such as a printer, a multifunction peripheral, a copier, or a facsimile machine) using toner and an electrophotographic method performs printing by forming a toner image on a photoreceptor drum, transferring the toner image onto a paper sheet, and fixing the toner image onto the paper sheet. Then, residual toner remaining on the photoreceptor drum without transferred is collected as waste toner. Further, a waste toner container for storing the waste toner may be disposed. When waste toner is continuously sent to the waste toner container despite the waste toner container is full, the waste toner may overflow and contaminate the inside of the image forming apparatus. In addition, when waste toner is continuously sent to the waste toner container despite the waste toner container is full, a large force may be applied to members for conveying waste toner (e.g. conveying screw and a conveying tube). As a result, members may be broken. Therefore, there is known a fullness detection device for detecting fullness of the waste toner container as follows.

For instance, there is known a waste toner fullness detection device including a waste toner collection container and a photosensor. The waste toner collection container includes a collection opening formed on a top surface of a book type storage portion for storing waste toner, so as to collect waste toner dropping to the storage portion, and a detection slit formed below the collection opening to protrude outward from the storage portion in such a manner that the center thereof is shifted from the waste toner dropping center in the collection opening, so that the waste toner level goes upward gradually along with increase of the waste toner stored in the storage portion. The photosensor detects the waste toner in the detection slit from outside of the waste toner collection container.

In this way, there is a case where the photosensor detects that waste toner is stored up to a certain level so that fullness of the waste toner container is detected. For instance, an optical sensor (a light emitting and a light receiving portion) sandwiches an upper end portion (neck portion) of a waste toner container having a certain transmittance, and transmitting light intensity is recognized on the basis of an output value of the light receiving portion. Because the waste toner interrupts light when the waste toner container becomes full, the light receiving portion cannot receive the light from the light emitting portion. For instance, it is determined that the waste toner container is full when the output value from the light receiving portion indicates that the light receiving portion receives little light when light emitting portion emits light.

The part of the waste toner container that transmits the light of the optical sensor is contaminated by the waste toner. In addition, the waste toner container is made of resin, and hence transmittance thereof is varied among individual waste toner containers. In addition, there is also a position error when disposing the optical sensor. In addition, there is also a position error when attaching the waste toner container. Because of these reasons, it is necessary to prevent a detection error even when worst conditions occur, by securing that the light from the light emitting portion reaches to the light receiving portion when the waste toner container is not full. Therefore, for example, when the fullness detection of the waste toner container is performed by using the optical sensor, maximum permissible rating power is supplied to the optical sensor considering worst conditions. In other words, the light emitting portion is driven to emit light at maximum intensity.

However, when the light emitting portion is always driven to emit light at maximum intensity (amount of luminescence) while the fullness detection of the waste toner container is performed, there is a case where the light intensity is higher than necessary. In other words, there is a case where non-fullness can be detected even when the light intensity of the light emitting portion is reduced to be lower than the maximum light intensity. Therefore, there is a problem that because the light emitting portion is driven at light intensity higher than a value necessary for detecting whether or not the waste toner container is full, for example, power is wastefully consumed, and life of a light emitting element of the light emitting portion is shortened.

Here, as to the known waste toner fullness detection device described above as an example, there is studied a position and the like of the detection slit. However, there is no description about light intensity of a light source of a photosensor 27. In addition, when the light source is always driven to emit light at light intensity lower than the maximum light intensity, there may occur a detection error such that fullness is detected though the waste toner container is not actually full, which causes an accuracy problem.

SUMMARY

In order to solve the above-mentioned problem, a fullness of a waste toner container detection device according to the present disclosure includes a waste toner collecting portion configured to collect waste toner, a waste toner container configured to store the waste toner collected by the waste toner collecting portion, the waste toner container has translucency, a detecting portion including a light emitting portion and a light receiving portion disposed to sandwich the waste toner container, the light emitting portion emitting light to the light receiving portion when a predetermined timing of performing the fullness detection of the waste toner container comes, the light receiving portion receiving light from the light emitting portion so as to output different values depending on received light intensity (light amount), a determining portion configured to determine whether or not the waste toner container is full based on whether or not an output value of the light receiving portion is higher than a predetermined threshold value, and a light emission controller configured to increase light intensity (light amount) of the light emitting portion step by step in the fullness detection and for controlling the light emitting portion to emit light at a level of smallest light intensity among light intensity levels (steps) at which the determining portion can determine that the waste toner container is not full.

Further features and advantages of the present invention will become apparent from the description of embodiments given below.

DETAILED DESCRIPTION

Now, there is described a printer 100 (corresponding to the image forming apparatus) including a fullness detection device 1 (a fullness of a waste toner container detection device) according to an embodiment with reference to FIG. 1 to FIG. 10. First, a first embodiment is described with reference to FIG. 1 to FIG. 9. In addition, a second embodiment is described with reference to FIG. 10 on the basis of FIG. 1 to FIG. 7. Here, elements such as structures and layouts described in the embodiments are merely examples which do not limit the scope of the disclosure.

(Outline Structure of Image Forming Apparatus)

Figure 1:
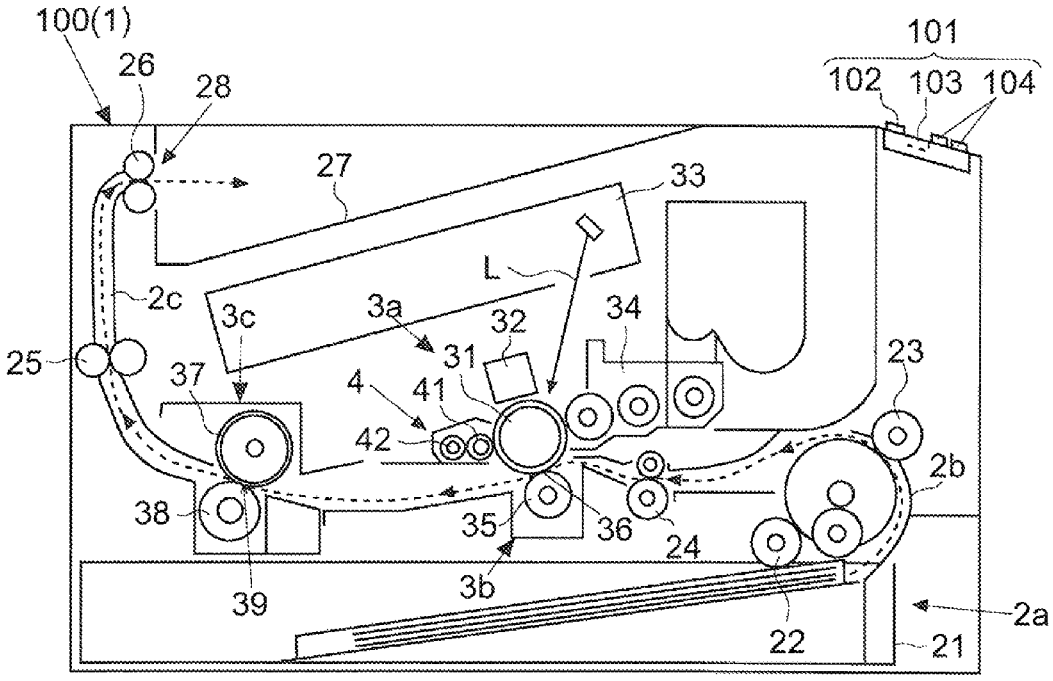
FIG. 1 is a diagram illustrating a printer according to an embodiment.

First, with reference to FIG. 1, outline of the printer 100 according to the embodiment is described. Note that the right side of FIG. 1 corresponds to a front side of the printer 100, and the left side corresponds to a rear side.

As illustrated in FIG. 1, a paper sheet feeder 2*a* for feeding paper sheets is disposed in a lower part of a main body of the printer 100. The paper sheet feeder 2*a* includes a cassette 21 attachable to and detachable from the printer 100. The paper sheets are stacked inside the cassette 21. Further, the paper sheet feeder 2*a* is equipped with a paper feed roller 22. The paper feed roller 22 is driven to rotate by a driving device (not shown) such as a motor and sends out a paper sheet to the upper right of the cassette 21 during printing.

On the downstream side in the paper sheet conveying direction of the paper sheet feeder 2*a*, there are disposed a first conveying portion 2*b* (including a conveying roller pair 23, a registration roller pair 24, and a guide), an image forming portion 3*a*, *a* transferring portion 3*b*, and a fixing portion 3*c*. The conveying roller pair 23 of the first conveying portion 2*b* conveys the paper sheet sent out from the cassette 21 to the registration roller pair 24. The registration roller pair 24 corrects skew feeding of paper sheet, measures timing with a toner image formed by the image forming portion 3*a*, and sends out the paper sheet to the transferring portion 3*b*.

The image forming portion 3*a* forms an image with toner. The toner image formed by the image forming portion 3*a* is transferred onto the paper sheet by the transferring portion 3*b*. The image forming portion 3*a* includes a photoreceptor drum 31 as a toner image bearing body, and a charging device 32, an exposure device 33, a developing device 34, and a cleaning device 4, which are disposed around the photoreceptor drum 31. The charging device 32 electrifies the photoreceptor drum 31 at a predetermined potential by corona discharge or the like. Note that the charging device 32 may be one using a roller or an electrifying brush. The exposure device 33 turns on and off a laser beam L so as to scan and expose the photoreceptor drum 31 after electrification on the basis of image data transmitted from an external computer 200 (see FIG. 2) or the like to the printer 100. Further, the exposure device 32 forms an electrostatic latent image on the surface of the photoreceptor drum 31. Then, the developing device 34 causes the toner to fly toward the electrostatic latent image for developing the toner image.

When the photoreceptor drum 31 rotates, the toner image enters a transfer nip portion 36 formed by the photoreceptor drum 31 and a transfer roller 35 of the transferring portion 3*b*, which are pressed to contact with each other. At this timing, the paper sheet driven by the registration roller pair 24 also enters the transfer nip portion 36. The transfer roller 35 is applied with a voltage having a polarity opposite to the electrification polarity of the toner. In this way, the toner image is transferred to the paper sheet.

As illustrated in FIG. 1, the cleaning device 4 is disposed on the left side of the photoreceptor drum 31. The cleaning device 4 removes residual toner remaining without being transferred and adhesion such as dust adhered to the photoreceptor drum 31 (hereinafter referred to as "waste toner T") from the photoreceptor drum 31 for cleaning. Specifically, a cleaning roller 41 extending in the direction parallel to an axis of the photoreceptor drum 31 so as to contact with the photoreceptor drum 31 is disposed in the cleaning device 4. For instance, when the toner image is formed, the cleaning roller 41 rotates in the same direction as the photoreceptor drum 31. Then, the cleaning roller 41 scrapes the surface of the photoreceptor drum 31 so as to remove the waste toner T. Further, as a member for collecting the waste toner T and for cleaning, instead of the cleaning roller 41 or in addition to the cleaning roller 41, a cleaning blush or a blade made of resin or the like may contact with the photoreceptor drum 31.

Further, on the left side of the cleaning roller 41 in FIG. 1, there is disposed a waste toner conveying member 42 extending in an axis direction of the cleaning roller 41. The waste toner conveying member 42 includes an impeller having a screw or helical shape and rotates when the toner image is formed. By this rotation, the waste toner T removed from the photoreceptor drum 31 by the cleaning roller 41 is conveyed in one of directions perpendicular to paper of FIG. 1 (the left and right directions of the printer 100). Then, the waste toner T is finally collected and stored in a waste toner container 5. The waste toner container 5 has light transmitting property. Further, the waste toner container 5 has an opening portion 52 for collecting the waste toner T discharged from an exhaust port 44. In addition, the waste toner container 5 is attached to the inside of a side face cover 100*c* of the device (the details will be described later; see FIG. 3 and FIG. 4).

On the downstream side in the paper sheet conveying direction of the image forming portion 3*a* and the transferring portion 3*b*, there are disposed the fixing portion 3*c*, *a* second conveying portion 2*c*, and a discharge tray 27. The paper sheet bearing an unfixed toner image in the transferring portion 3*b* is conveyed to the fixing portion 3*c*. The fixing portion 3*c* includes a heating roller 37 in which a heating body is embedded and a pressing roller 38 pressed to contact with the heating roller 37 so that a fixing nip portion 39 is formed. When the paper sheet enters this nip portion, the toner image is fixed. The paper sheet discharged from the fixing portion 3*c* passes through the second conveying portion 2*c*. The second conveying portion 2*c* includes a conveying roller pair 25 and a discharge roller pair 26. The second conveying portion 2*c* conveys upward the paper sheet discharged from the fixing portion 3*c*. The paper sheet is discharged from a paper sheet discharging port 28 to the discharge tray 27 on the uppermost part of the main body. In this way, image formation (printing) of one paper sheet is completed.

(Hardware Structure of Printer 100)

Next, a hardware structure of the printer 100 according to the embodiment is described with reference to FIG. 2.

Figure 2:
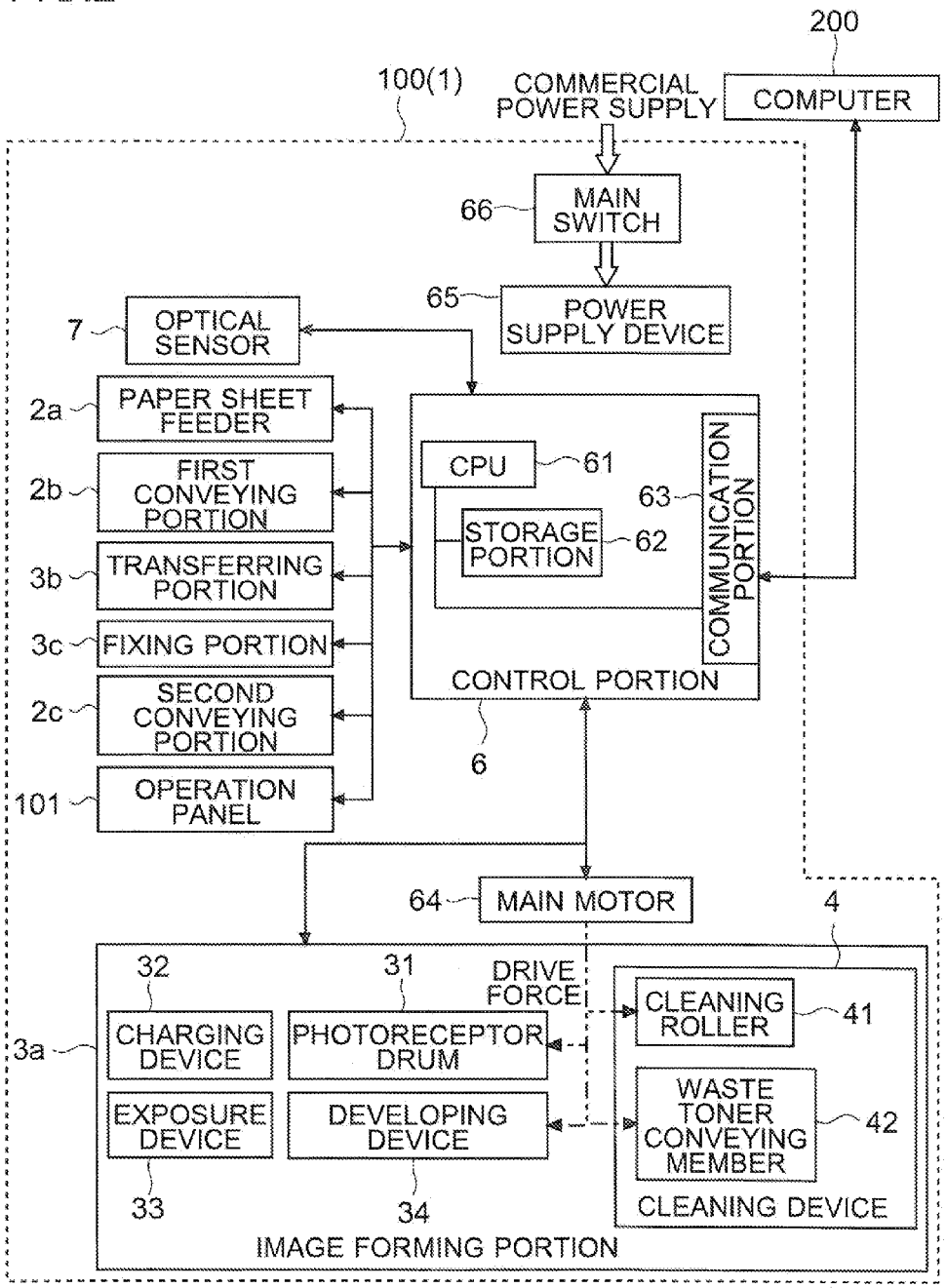
FIG. 2 is a block diagram of a printer according to the embodiment.

First, as illustrated in FIG. 2, the printer 100 of this embodiment includes a substrate, electronic components and the like, in the main body. Further, the printer 100 is equipped with a control portion 6 (corresponding to the determining portion) for controlling operation of the apparatus. The control portion 6 includes a CPU 61, a storage portion 62, a communication portion 63 and the like. Note that the control portion 6 performs operation control, communication control and image processing. The control portion 6 may be divided into functional portions including a main control portion for performing general control, an engine control portion for performing image formation, turning on and off of motors for driving various rotation members so as to control printing, and the like. In this description, a form in which these control portions are integrated is described.

Further, the CPU 61 of the control portion 6 functions as a central processing unit. The CPU 61 performs various calculation operations, control of individual portions of the printer 100, and various detections, on the basis of programs and data stored in the storage portion 62. In addition, the control portion 6 controls operation of the image forming portion 3*a*. In addition, the control portion 6 receives an output value of a light receiving portion 72 of an optical sensor 7 (corresponding to the detecting portion) and controls on and off of a light emitting portion 71 of the optical sensor 7 (the details will be described later).

The storage portion 62 is a combination of storage devices such as a RAM, a ROM, an HDD and a flash ROM. This storage portion 62 can store control programs, data, image data, set information of the printer 100, and the like, in a volatile or nonvolatile manner. Further, the control portion 6 or the CPU 61 uses the information stored in the storage portion 62 for controlling the printer 100. In addition, the storage portion 62 stores a threshold value for the output value of the light receiving portion 72 in a light emitting state of the light emitting portion 71 (a threshold value for detecting whether or not the waste toner container 5 is full).

The communication portion 63 includes a plurality of types of connectors and sockets and is an interface for connecting the printer 100 to the external computer 200 (such as a personal computer or a server) and the like via a cable (such as a USB cable) or a network in a communicable manner. Then, the control portion 6 receives print data including image data and setting data for printing transmitted from the computer 200 and the like, and performs image formation in accordance with the received print data. Note that FIG. 2 illustrates only one computer 200 for convenience sake. However, the communication portion 63 may be connected to a plurality of computers 200 in a communicable manner.

In addition, the control portion 6 is connected to individual portions in the printer 100 via an I/O port (not shown) and a bus (not shown). The control portion 6 controls operations of individual portions such as the paper sheet feeder 2*a*, the first conveying portion 2*b*, the second conveying portion 2*c*, the image forming portion 3*a*, the transferring portion 3*b*, the fixing portion 3*c*, an operation panel 101 and the optical sensor 7.

The control portion 6 controls and instructs electric operations of the charging device 32, the exposure device 33 and the developing device 34 (such as laser power in the exposure device 33, voltage application in the charging device 32 and the developing device 34). In addition, the control portion 6 controls on and off of a main motor 64 for supplying a drive force for rotating the photoreceptor drum 31, the cleaning roller 41 of the cleaning device 4, the waste toner conveying member 42 and the like. In the printing operation, the control portion 6 turns on the main motor 64 so as to rotate the photoreceptor drum 31, the cleaning roller 41, the waste toner conveying member 42 and the like. In addition, the control portion 6 (CPU 61) is connected to the optical sensor 7 for detecting fullness of the waste toner container 5, and the like. The control portion 6 controls on and off of the optical sensor 7 and further detects fullness of the waste toner container 5 on the basis of an output value of the optical sensor 7.

In addition, a power supply device 65 is disposed inside the printer 100. The power supply device 65 is supplied with power from a commercial power source. In addition, the power supply device 65 includes a rectifying circuit, a smoothing circuit, a voltage dropping circuit, a voltage raising circuit and the like. Further, the power supply device 65 generates a plurality of voltages necessary for driving the printer 100. In addition, there is disposed a main switch 66 for turning on and off a main power supply for the printer 100.

(Outline of Waste Toner Collection)

Next, outline of collection of the waste toner T in the printer 100 according to the embodiment is described with reference to FIGS. 1 and 3.

First, as illustrated in FIG. 1, the operation panel 101 is disposed on the front upper part of the printer 100. The operation panel 101 includes an indicator 102 constituted of a plurality of LEDs 71*a*, a liquid crystal display portion 103 and a plurality of keys 104 for various setting. For instance, using the keys 104, it is possible to perform various operations and settings of the printer 100 such as selection of size of paper sheets to be used.

The operation panel 101 displays a status of the printer 100 such as fullness of the waste toner container 5 and various messages using the indicator 102 and the liquid crystal display portion 103. In addition, the operation panel 101 can display printing status or the like such as printable status, error status, printing status, and print completion status. For displaying the status, the operation panel controls on and off of the indicator 102, and controls the liquid crystal display portion 103 to display a character string. For instance, when fullness of the waste toner container 5 is detected, the liquid crystal display portion 103 displays a message like "CHECK WASTE TONER BOTTLE".

Figure 3:
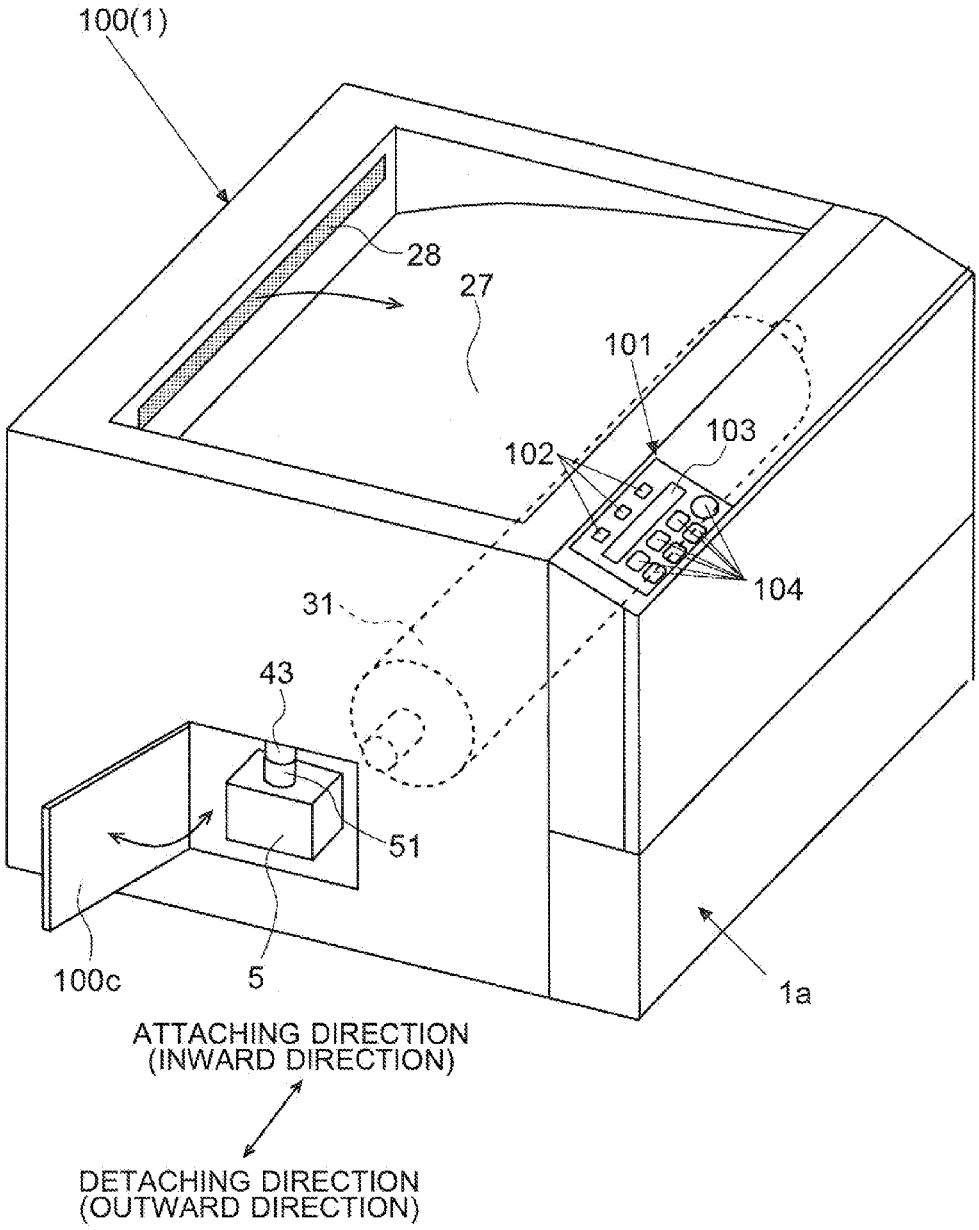
FIG. 3 is a perspective view of the printer according to the embodiment viewed from above and left.

Then, as illustrated in FIG. 3, the printer 100 includes the openable and closable side face cover 100*c* (the open and close direction is illustrated by a solid line with arrows) as a part of a casing of the apparatus. The waste toner container 5 is attached at a position exposed when the side face cover 100*c* is opened. In other words, the waste toner container 5 is attached to the inside of the side wall of the printer 100. Further, as illustrated in FIG. 3, the waste toner container 5 is disposed at a lower end of an exhaust pipe 43 for the waste toner T extending in the up and down direction. The waste toner container 5 is supported in such a manner that the exhaust port 44 for discharging the waste toner T from the image forming portion 3*a* and the opening portion 52 of the waste toner container 5 are connected to each other (the details will be described later).

In addition, when the waste toner container 5 is detached for exchange due to fullness of the waste toner container 5, the user opens the side face cover 100*c* of the printer 100. Then, the waste toner container 5 is moved and drawn in the detaching direction (outward direction), and hence the waste toner container 5 can be detached. When the user attaches a new waste toner container 5, the waste toner container 5 is moved in the attaching direction (inward direction). Note that FIG. 3 illustrates the photoreceptor drum 31 by a broken line as a reference. In addition, a solid line arrow in the upper part of the printer 100 in FIG. 3 indicates an example of a discharging direction of a printed paper sheet.

(Waste Toner Collection Mechanism)

Next, a waste toner collection mechanism according to the embodiment is described with reference to FIGS. 4 and 5. Note that portions other than the photoreceptor drum 31 and the cleaning device 4 of the image forming portion 3*a* are not illustrated in FIG. 4 for convenience sake.

Figure 4:
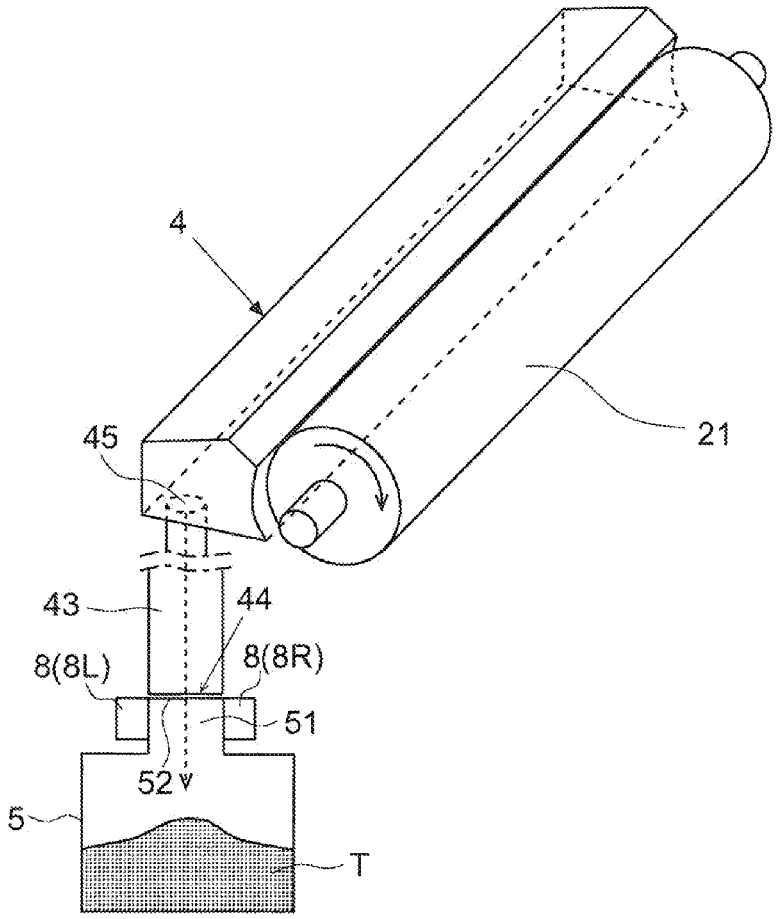
FIG. 4 is an explanatory diagram of a waste toner collection mechanism according to the embodiment.

As illustrated in FIG. 4, the cleaning device 4 is disposed along the axis direction of the photoreceptor drum 31. Further, as described above with reference to FIG. 1, the cleaning roller 41 and the waste toner conveying member 42 (e.g. the screw) extending in the axis direction of the photoreceptor drum 31 are disposed in the cleaning device 4 (invisible in FIG. 4). Further, an opening portion 45 for discharging the waste toner T from the cleaning device 4 is disposed on the under face of the cleaning device 4 at one end. This opening portion 45 is connected to the exhaust pipe 43 for conveying out the waste toner T in the cleaning device 4.

Further, the waste toner conveying member 42 conveys the waste toner T in the cleaning device 4 toward the opening portion 45 and the exhaust pipe 43. In this way, the waste toner T is conveyed from the cleaning device 4 to the exhaust pipe 43. The exhaust pipe 43 extends in the up and down direction. On the other end of the exhaust pipe 43 opposite to the end connected to the opening portion 45, there is disposed the exhaust port 44 for discharging the waste toner T from the image forming portion 3*a*. The waste toner container 5 is connected to the exhaust port 44. Then, the waste toner T drops and is collected in the waste toner container 5. In this way, the cleaning device 4, the waste toner conveying member 42, the opening portion 45, the exhaust pipe 43 and the like function as the waste toner collecting portion for collecting the waste toner T.

As illustrated in FIG. 4, the waste toner container 5 is supported by a support portion 8. The support portion 8 sandwiches and holds a neck portion 51 of the waste toner container 5.

Figure 5:
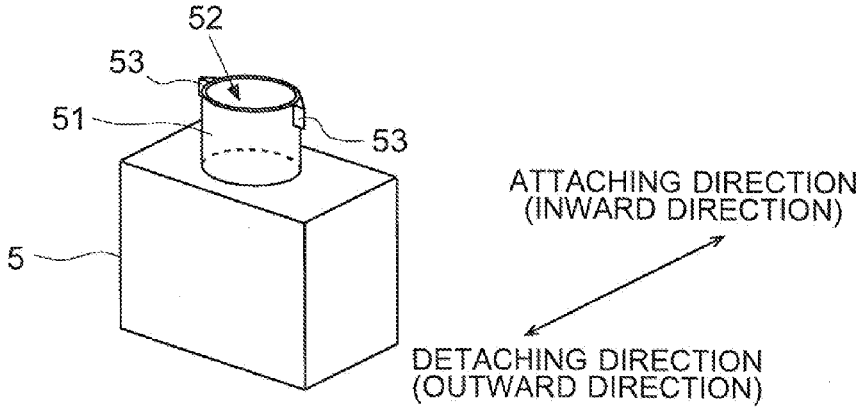
FIG. 5 is a perspective view illustrating a waste toner container according to the embodiment.

Next, with reference to FIGS. 4 and 5, an example of a shape of the waste toner container 5 is described. The waste toner container 5 of this embodiment includes the neck portion 51 having a cylindrical shape (or a square tube shape) on the top portion. The upper part of the neck portion 51 is opened to be the opening portion 52. The waste toner T is input from the opening portion 52 to the waste toner container 5. Note that diameter of the opening portion 52 is equal to or larger than diameter of the exhaust port 44.

In addition, on the upper end of the outer wall of the neck portion 51, there are formed locking portions 53 having a protruding shape (triangular prism shape) for holding the waste toner container 5. Two locking portions 53 are disposed to be opposed to each other. The locking portions 53 are disposed at positions at which the support portion 8 contacts with the neck portion 51 (positions overlapping a diameter of the opening portion 52 perpendicular to the attaching and detaching direction of the waste toner container 5) when the waste toner container 5 is attached. Then, the locking portions 53 of the waste toner container 5 are respectively fit in recesses (not shown) formed in the support portion 8, and hence the waste toner container 5 is supported.

(Fullness Detection of the Waste Toner Container 5 and Optical Sensor 7)

Next, fullness detection of the waste toner container according to the embodiment 5 is described with reference to FIG. 6 and FIG. 7.

Figure 6:
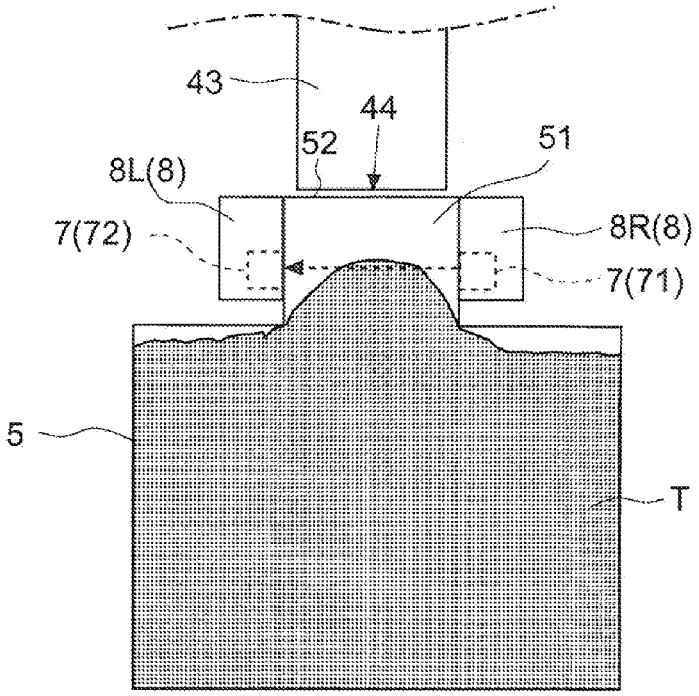
FIG. 6 is a diagram illustrating fullness detection of the waste toner container according to the embodiment.

First, as illustrated in FIG. 6, the support portion 8 is constituted of two opposed members having a square column shape, for example. The support portions 8 sandwich the neck portion 51 so as to support the waste toner container 5. The right side member of the two support portions 8 is denoted by 8R, and the left side member is denoted by 8L in FIG. 4 and FIG. 6. When referring to the right and left support portions 8 as one unit, the suffix R or L is omitted.

Further, the waste toner container 5 stores the waste toner T collected by the waste toner collecting portion. In addition, the waste toner container 5 is made of light transparent material (e.g. resin having light transparent or translucent property). In addition, an optical sensor 7 is embedded in the support portion 8. The light emitting portion 71 (e.g. the LED 71*a*; see FIG. 8) is embedded in the support portion 8R. On the other hand, the light receiving portion 72 (e.g. a phototransistor 72*a*; see FIG. 8) is embedded in the support portion 8L, so as to be opposed to the light emitting portion 71 in the direction of light emitted from the light emitting portion 71, to receive the light emitted from the light emitting portion 71, and delivers an output value changing in accordance with the received light intensity (an example of an optical path of the light from the light emitting portion 71 is illustrated by a broken line).

In this way, the optical sensor 7 includes the light emitting portion 71 and the light receiving portion 72 disposed to sandwich the opening portion 52 (neck portion 51) of the waste toner container 5, in which the light receiving portion 72 receives the light from the light emitting portion 71 and delivers an output value different depending on the received light intensity (light amount). In other words, the light emitting portion 71 and the light receiving portion 72 constitute a transmission type optical sensor 7 for the waste toner container 5. Note that the light emitting portion 71 and the light receiving portion 72 may have opposite positional relationship.

Figure 7:
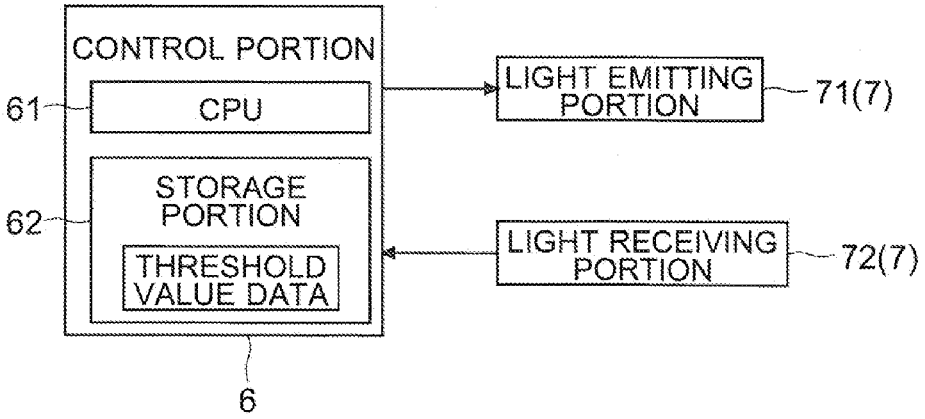
FIG. 7 is a block diagram illustrating a portion for performing the fullness detection on the basis of an optical sensor according to the embodiment.

Here, with reference to FIG. 7, outline of the fullness detection is described. The fullness detection of the waste toner container 5 is performed by using the optical sensor 7. The fullness detection is performed at predetermined timing. In the fullness detection, the control portion 6 (CPU 61) turns on the light emitting portion 71. Then, the control portion 6 receives the output value of the light receiving portion 72. Then, the control portion 6 determines whether or not the waste toner container 5 is full on the basis of whether or not the output value of the light receiving portion 72 is higher than a predetermined threshold value. For instance, the threshold value may be the output value of the light receiving portion 72 considering ambient light when the light emitting portion 71 does not emit light. Data indicating the threshold value is stored in the storage portion 62, for example.

For instance, the fullness detection of the waste toner container 5 is performed when a process using toner is performed. As the process using toner, there are a printing (toner image formation) process, a toner refresh process (a process of putting the toner on the photoreceptor drum 31 without transferring onto the paper sheet in order to intentionally discharge the toner inside the developing device 34), and the like. For instance, the control portion 6 periodically detects whether or not the waste toner container 5 is full during a period from the beginning to the end of the process using toner (e.g. printing job start, during printing job, and the like). The period can be arbitrarily determined. For instance, the control portion 6 determines whether or not the waste toner container 5 is full every a few seconds.

In the printer 100 of this embodiment, the output value of the light receiving portion 72 becomes larger as the received light intensity becomes larger. Further, as illustrated in FIG. 6, when the waste toner T is accumulated so as to interrupt the light from the light emitting portion 71, the output value of the light receiving portion 72 becomes the threshold value or lower even when the light emitting portion 71 is driven to emit light at the maximum light intensity. In this case, the control portion 6 determines that the waste toner container 5 has become full. On the other hand, when the light emitting portion 71 is driven to emit light at any light intensity, when the output value of the light receiving portion 72 exceeds the threshold value, it can be determined that the waste toner T is not accumulated in such a manner to interrupt the optical path of the light emitting portion 71. Therefore, the control portion 6 determines that the waste toner container 5 is not full.

(Circuit Structure of Fullness Detection Device 1)

Figure 8:
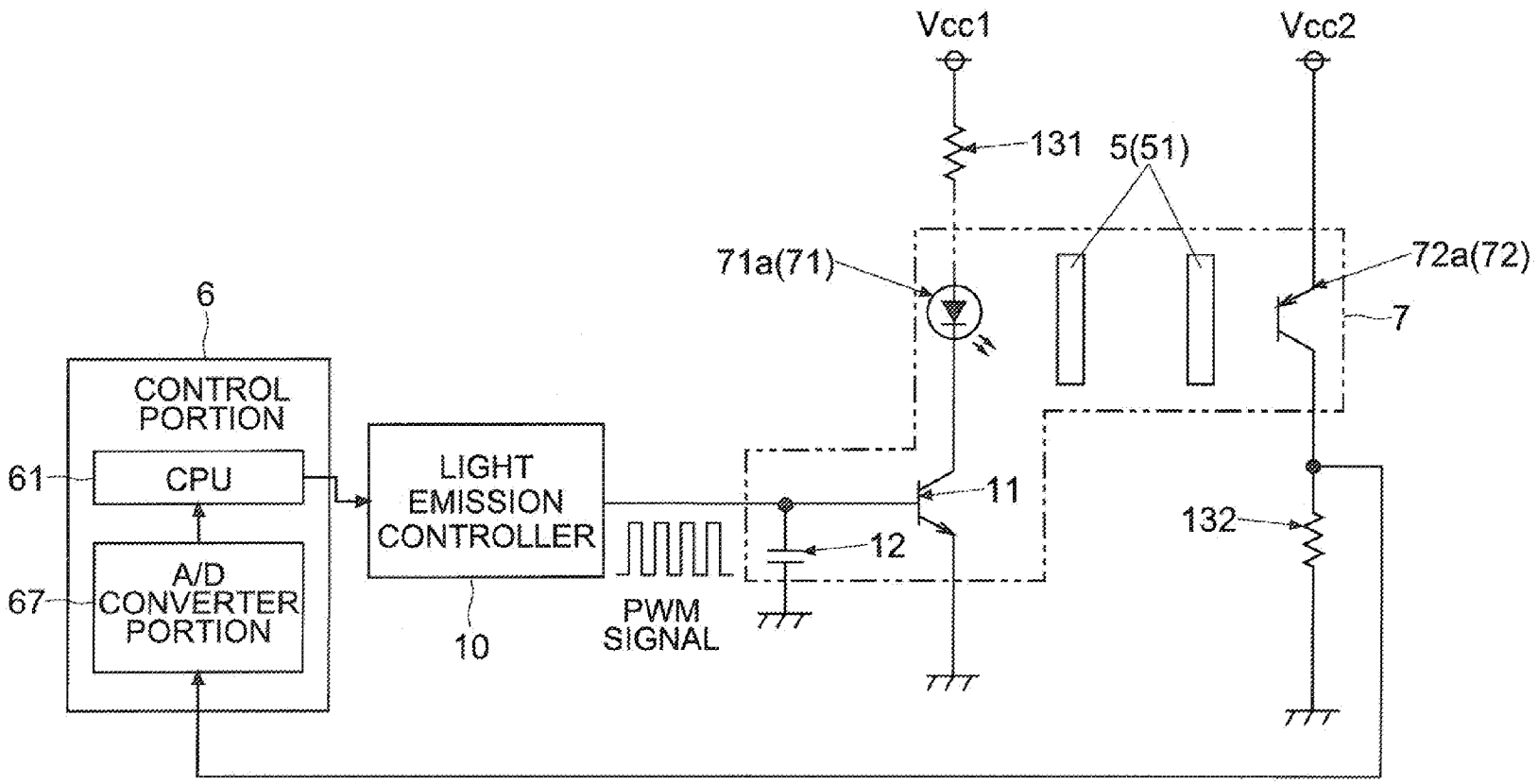
FIG. 8 is a circuit diagram illustrating a fullness detection device according to a first embodiment.

Next, with reference to FIG. 8, an example of a circuit structure of the fullness detection device 1 according to the first embodiment is described.

The printer 100 of this embodiment includes the fullness detection device 1. The fullness detection device 1 includes the above-mentioned waste toner container 5, the waste toner collecting portion, the optical sensor 7, the control portion 6, a light emission controller 10 and the storage portion 62. In this way, the fullness detection device 1 is constituted as a part of the printer 100.

The light emission controller 10 is a circuit for delivering a PWM signal having a predetermined frequency (period) on the basis of an instruction from the control portion 6 (CPU 61). Note that the light emission controller 10 may be included in the control portion 6. Alternatively, when the CPU 61 has a function of generating the PWM signal, it is possible to use the CPU 61 as the light emission controller 10.

An anode of the LED 71*a* as the light emitting portion 71 is connected to a power supply Vcc1 via a resistor 131. A constant DC voltage applied from the power supply Vcc1 is generated by the power supply device 65 (see FIG. 2) disposed in the printer 100. For instance, the power supply device 65 generates a voltage for the power supply Vcc1 for turning on the light emitting portion 71.

Further, there is disposed a transistor 11 (a part of the detecting portion) for adjusting amount of current to be supplied to the light emitting portion 71. A cathode of the LED 71*a* is connected to a collector of the transistor 11. The transistor 11 in this embodiment is an npn type. In addition, an emitter of the transistor 11 is connected to the ground. In addition, a base of the transistor 11 and the light emission controller 10 are connected to each other via a signal line.

Further, a capacitor 12 (a part of the detecting portion) is connected to a line connecting the base of the transistor 11 with an output of the light emission controller 10. The capacitor 12 is charged by the PWM signal output from the light emission controller 10. In other words, the capacitor 12 smoothes the PWM signal. The signal smoothed by the capacitor 12 is supplied to the base of the transistor 11. The charging potential increases or decreases current flowing in a series circuit of the resistor 131, the LED 71*a* and the transistor 11. Specifically, the current flowing in the series circuit of the resistor 131, the LED 71*a* and the transistor 11 becomes larger as potential of the capacitor 12 becomes higher. Then, light intensity (light emission level) of the light emitting portion 71 (LED 71*a*) becomes larger. On the contrary, as the potential of the capacitor 12 becomes lower, the current flowing in the series circuit of the resistor 131, the LED 71*a* and the transistor 11 becomes smaller. Then, the light intensity (light emission level) of the light emitting portion 71 (LED 71*a*) becomes smaller.

In this way, the transistor 11 changes the current supplied to the light emitting portion 71 in accordance with the potential of the charged capacitor 12. Here, the light emission controller 10 delivers the PWM signal. Therefore, in order to increase the light intensity of the LED 71*a*, the light emission controller 10 increases an on-duty time (increases a duty ratio) of the PWM signal. In this way, the potential of the capacitor 12 is raised. As a result, the transistor 11 increases current supplied to the LED 71*a* so that the light intensity of the LED 71*a* is increased. On the contrary, in order to decrease the light intensity of the LED 71*a*, the light emission controller 10 decreases the on-duty time (decreases the duty ratio) of the PWM signal. In this way, the potential of the capacitor 12 is dropped. As a result, the transistor 11 decreases current supplied to the LED 71*a* so that the light intensity of the LED 71*a* is decreased.

Here, the light emission controller 10 can change the duty ratio (on-duty time) step by step. For instance, the light emission controller 10 can change the duty ratio by step of 1% (or by step of a few percent, or by step of 10%). In this way, the light emission controller 10 can change the duty ratio in a plurality of levels (steps). In this way, the light emission controller 10 changes the potential of the capacitor 12 step by step on the basis of an instruction of the control portion 6 so that the transistor 11 can change current supplied to the LED 71*a* (light emitting portion 71). Thus, the light intensity of the light emitting portion 71 can be changed step by step.

Further, when the waste toner container 5 is not full, the light emitted from the light emitting portion 71 (LED 71*a*) passes through the waste toner container 5 to reach the light receiving portion 72. The phototransistor 72*a* can be used for the light receiving portion 72.

As illustrated in FIG. 8, the phototransistor 72*a* of this embodiment is a pnp type. An emitter of the phototransistor 72*a* is connected to a power supply Vcc2. A constant DC voltage applied from the power supply Vcc2 is generated by the power supply device 65 disposed in the printer 100. In addition, a collector of the phototransistor 72*a* is connected to the ground via a resistor 132.

A voltage between the collector of the phototransistor 72*a* and the resistor 132 is delivered to the control portion 6 as the output value of the light receiving portion 72. For instance, the voltage as the output of the light receiving portion 72 is supplied to an A/D converter portion 67 of the control portion 6. The A/D converter portion 67 performs analog to digital conversion of the output of the light receiving portion 72 and delivers a digital value indicating the output of the light receiving portion 72 to the CPU 61. Further, when the CPU 61 includes an A/D conversion process circuit, the CPU 61 can perform the A/D conversion process without the A/D converter portion 67. In this way, the CPU 61 recognizes the output value of the light receiving portion 72. In addition, the control portion 6 (CPU 61) can recognize whether or not the output value of the light receiving portion 72 is higher than a predetermined threshold value.

When the waste toner container 5 is not full, the light intensity of the light emitting portion 71 (LED 71*a*) becomes higher as the duty ratio of the PWM signal becomes larger. Therefore, the output value (output voltage) of the light receiving portion 72 (phototransistor 72*a*) becomes larger. On the contrary, as the duty ratio of the PWM signal becomes smaller, the light intensity of the light emitting portion 71 (LED 71*a*) becomes lower. Then, the output value (output voltage) of the light receiving portion 72 (phototransistor 72*a*) becomes smaller. In addition, even when the light emitting portion 71 is turned on when the waste toner container 5 is full, the output value of the light receiving portion 72 is substantially zero because the waste toner T blocks the light. Therefore, even when the duty ratio is changed, the output value does not change.

(Flow of Fullness Detection)

Figure 9:
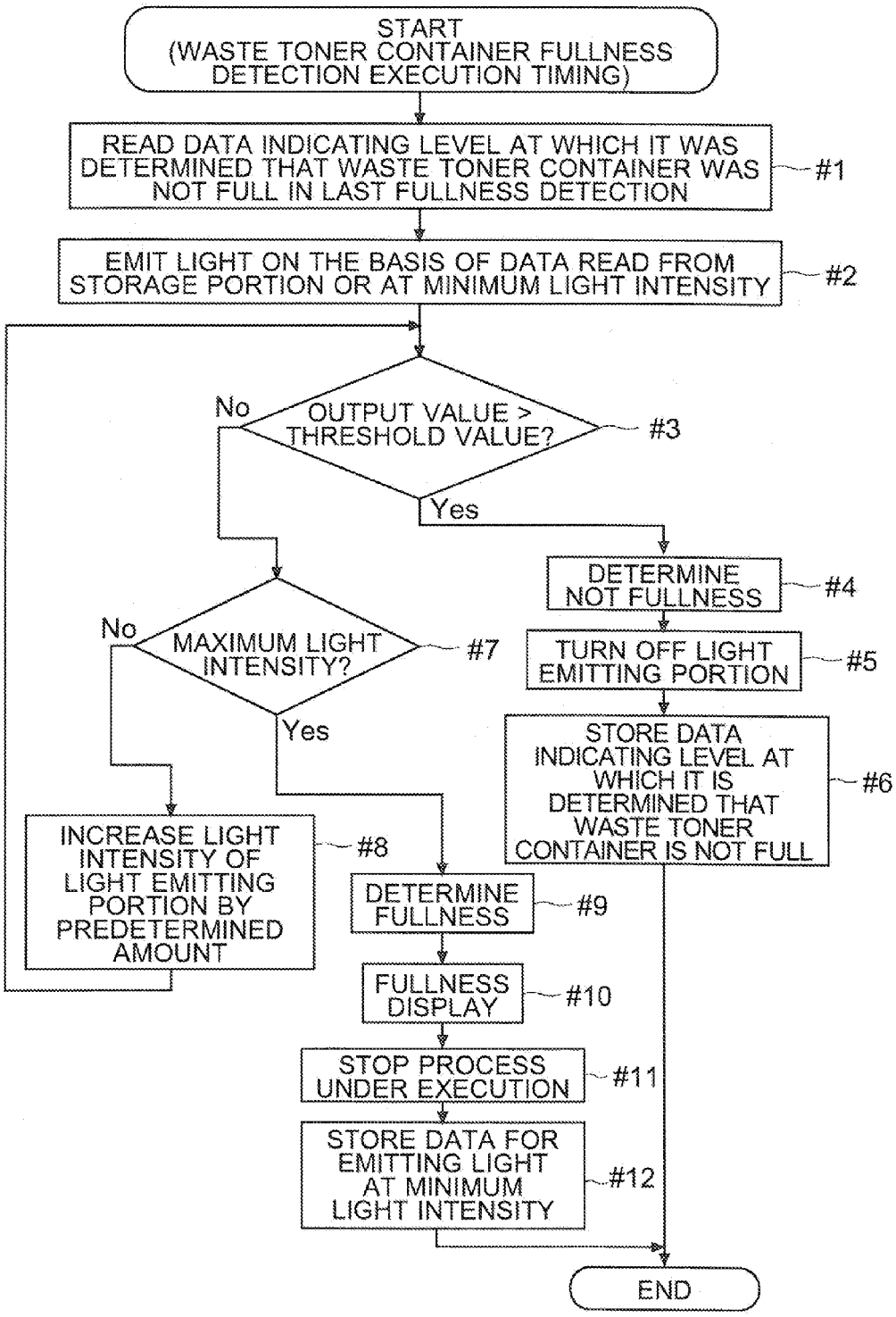
FIG. 9 is a flowchart illustrating a fullness detection flow according to the embodiment.

Next, with reference to FIG. 9, an example of a flow of the fullness detection of the fullness detection device 1 according to the embodiment is described.

First, the flow of FIG. 9 starts when a predetermined timing has come for performing the fullness detection of the waste toner container 5. The fullness detection of the waste toner container 5 is performed when a process using toner is performed. Therefore, the flow of FIG. 9 starts when the process using toner is started or while the process using toner is being performed, for example. In addition, it is possible to perform the fullness detection of the waste toner container 5 when the main power supply is turned on.

First, the control portion 6 reads data from the storage portion 62, which indicates a light intensity level (duty ratio) of the light emitting portion 71 at which it was determined that the waste toner container 5 was not full in the last fullness detection (Step #1). Here, as described later in detail, the duty ratio of the PWM signal is switched step by step so that the light intensity of the light emitting portion 71 (current supplied to the light emitting portion 71) is switched step by step (light intensity is increased step by step). Therefore, the control portion 6 controls the storage portion 62 to store a duty ratio (on-duty time) at which it is decided that the waste toner container 5 is not full while the light intensity of the light emitting portion 71 is being increased step by step, as data indicating the level at which it was determined that the waste toner container 5 was not full.

Further, the control portion 6 controls the light emission controller 10 to generate the PWM signal on the basis of the data (duty ratio) read from the storage portion 62, so as to turn on the light emitting portion 71 (Step #2). In this way, the storage portion 62 stores the data indicating the level at which it was determined that the waste toner container 5 was not full in the last fullness detection. Then, when the timing of performing the fullness detection of the waste toner container 5 comes, the control portion 6 instructs the light emission controller 10 to control the light emitting portion 71 to start light emission at light intensity of the level (duty ratio) stored in the storage portion 62.

Here, it is possible to control the storage portion 62 to store data in a volatile manner, indicating the level at which it was determined that the waste toner container 5 was not full. In this case, at a first time point when after the main power supply for the printer 100 is turned on, the data indicating the level at which it was determined that the waste toner container 5 was not full is lost. Therefore, the control portion 6 controls the light emission controller 10 to generate the PWM signal at a predetermined minimum duty ratio. In this way, the light emission controller 10 controls the light emitting portion 71 to emit light at a predetermined minimum light intensity (that is necessary at least for performing the fullness detection). Therefore, in Step #2, it is possible to turn on the light emitting portion 71 at the minimum light intensity. In other words, the light intensity of the light emitting portion 71 can be reset to be minimum every time when the main power supply of the printer 100 is turned off.

Further, it is possible to determine the predetermined minimum duty ratio by considering transmittance of a new waste toner container 5. Specifically, it is possible to set the minimum duty ratio as a duty ratio to be approximately the predetermined threshold value of the output value of the light receiving portion 72 as a specification when a new waste toner container 5 is attached and the light emitting portion 71 is controlled to emit light.

Further, the control portion 6 checks whether or not the output value of the light receiving portion 72 has exceeded the predetermined threshold value (Step #3). Further, in order to avoid a detection error, the control portion 6 may finally determine that the output value of the light receiving portion 72 has exceeded the threshold value when it is checked that the output value of the light receiving portion 72 has exceeded the predetermined threshold value consecutively a plurality of times.

When the output value of the light receiving portion 72 has exceeded the predetermined threshold value (Yes in Step #3), the control portion 6 determines that the waste toner container 5 is not full (Step #4). Then, the control portion 6 controls the light emission controller 10 to turn off the light emitting portion 71 (Step #5).

Further, the control portion 6 controls the storage portion 62 to store the data indicating the level at which it was determined that the waste toner container 5 was not full (Step #6). Specifically, the control portion 6 controls the storage portion 62 to store the duty ratio of the PWM signal when it is determined that the waste toner container 5 is not full. Then, this flow is finished (END). After that, during the process using toner, the flowchart starts when a certain period time has elapsed.

On the contrary, when the output value of the light receiving portion 72 is the predetermined threshold value or lower (No in Step #3), the control portion 6 checks whether or not light intensity of the light emitting portion 71 is maximum (whether or not the duty ratio of the PWM signal is 100%) (Step #7).

When the light intensity of the light emitting portion 71 is not maximum (No in Step #7), the control portion 6 controls the light emission controller 10 to control the light emitting portion 71 to emit light after increasing the light intensity of the light emitting portion 71 by a predetermined amount (Step #8). Specifically, the control portion 6 controls the light emission controller 10 to increase the duty ratio of the PWM signal by a predetermined step (e.g. a few percent). In this way, until the determining portion determines that the waste toner container 5 is not full, the control portion 6 switches the light intensity step by step by instructing the light emission controller 10 to increase the light intensity of the light emitting portion 71 step by step. Therefore, the control portion 6 instructs the light emission controller 10 to change the light intensity of the light emitting portion 71 step by step, so as to control the light emitting portion 71 to emit light at the level of the smallest light intensity among the light intensity levels (steps) at which the control portion 6 determines that the waste toner container 5 is not full. Then, the flow returns to Step #3.

On the contrary, when the light intensity of the light emitting portion 71 is maximum (Yes in Step #7), the control portion 6 determines that the waste toner container 5 is full (Step #9). Then, the control portion 6 controls the operation panel 101 to display a display indicating that the waste toner container 5 is full (Step #10). Further, in order to prevent the waste toner T from overflowing the waste toner container 5, the control portion 6 stops the current process using toner, when necessary (Step #11).

Then, the control portion 6 controls the storage portion 62 to store the light intensity of the light emitting portion 71 as the data for controlling the light emitting portion 71 to emit light at the minimum light intensity (data indicating the minimum light intensity) in the fullness detection (Step #12). Specifically, the control portion 6 controls the storage portion 62 to store the predetermined minimum duty ratio. In this way, when the fullness of the waste toner container 5 is detected, the light intensity of the light emitting portion 71 is reset to be minimum. Therefore, when a new waste toner container 5 is attached, the fullness detection is started at the level of light intensity necessary at least for performing the fullness detection (predetermined minimum light intensity), and the light emitting portion 71 is not turned on at light intensity higher than the necessary level after the new waste toner container 5 is attached. Then, this flow is finished (END).

Note that the support portion 8 is provided with a shutter (not shown). The shutter works together with attachment and detachment of the waste toner container 5. When the waste toner container 5 is detached, the shutter is closed so that the light receiving portion 72 is maintained in a light-blocking state. In addition, when the waste toner container 5 is attached, the shutter is opened. Then, after the fullness is detected, the light emitting portion 71 is controlled to emit light. When the output value of the light receiving portion 72 becomes a value (e.g., the predetermined threshold value) at which it is determined that the light receiving portion 72 receives light, the control portion 6 recognized that the waste toner container 5 is exchanged.

In this way, the fullness detection device 1 of this embodiment includes a waste toner collecting portion configured to collect the waste toner T (the cleaning device 4, the waste toner conveying member 42, the opening portion 45, the exhaust pipe 43 and the like), the waste toner container 5, the detecting portion (optical sensor 7), the determining portion (control portion 6), and the light emission controller 10. The waste toner collecting portion (cleaning device 4, waste toner conveying member 42, opening portion 45, exhaust pipe 43 and the like) collects the waste toner T. The waste toner container 5 stores the waste toner T collected by the waste toner collecting portion and has translucency. The detecting portion is disposed to sandwich the waste toner container 5 and includes the light emitting portion 71 for emitting light to the light receiving portion (72) when the predetermined timing of performing the fullness detection of the waste toner container 5 comes, and the light receiving portion 72 for receiving light from the light emitting portion 71 so as to output values different depending on intensity of the received light intensity (received light amount). The determining portion determines whether or not the waste toner container 5 is full in accordance with whether or not the output value of the light receiving portion 72 is higher than a predetermined threshold value. The light emission controller 10 increases the light intensity (light amount) of the light emitting portion 71 step by step in the fullness detection, and controls the light emitting portion 71 to emit light at a level of smallest light intensity (light amount) among light intensity levels (steps) at which the determining portion (control portion 6) can determine that the waste toner container 5 is not full.

The light intensity becomes higher as input (consumption) energy is larger, and the light emitting portion 71 is controlled not to emit light continuously at the maximum light intensity. Therefore, wasteful power consumption can be eliminated. In addition, because heat generated by the light emitting portion 71 is suppressed, life of the light emitting element of the light emitting portion 71 can be elongated. In addition, because the light intensity of the light emitting portion 71 for detecting that the waste toner container 5 is not full is secured, it is possible to accurately detect whether or not the waste toner container 5 is full.

In addition, the light emission controller 10 changes the light intensity of the light emitting portion 71 step by step until the determining portion (control portion 6) determines that the waste toner container 5 is not full. Then, the determining portion determines that the waste toner container 5 is full when the output value of the light receiving portion 72 is the threshold value or lower even when the light emitting portion 71 emits light at the permissible maximum light intensity. In this way, wasteful power consumption is eliminated, life of the light emitting element of the light emitting portion 71 is elongated, and it is possible to accurately determine whether or not the waste toner container 5 is full.

In addition, there is disposed the storage portion 62 configured to store the level at which it was determined that the waste toner container 5 was not full in the last fullness detection. When the timing of performing the fullness detection of the waste toner container 5 comes, the light emitting portion 71 starts light emission at light intensity at the level stored in the storage portion 62. In this way, in the fullness detection of the waste toner container 5, the light emitting portion 71 is supplied with current close to a level at which it can be determined that the waste toner container 5 is not full. In this way, it is possible to rapidly detect whether or not the waste toner container 5 is full.

In addition, when the timing of performing the fullness detection of the waste toner container 5 comes, the light emitting portion 71 may start light emission at light intensity of a predetermined minimum level. The light emitting portion 71 is not controlled to emit light at light intensity higher than necessary level. In addition, it is possible to reset the light intensity of the light emitting portion 71 to be minimum at each timing of performing the fullness detection.

In addition, the light emission controller 10 delivers the PWM signal as a signal for controlling the light intensity of the light emitting portion 71. The light emitting portion 71 changes the duty ratio of the PWM signal step by step so that the light intensity is changed step by step. In this way, light emission intensity of the light emitting portion 71 (current supplied to the light emitting portion 71) can be adjusted step by step.

In addition, the detecting portion (optical sensor 7) includes the transistor 11 for adjusting current to the light emitting portion 71, and the capacitor 12 connected to the line connecting the transistor 11 with the light emission controller 10. The capacitor 12 is charged by the PWM signal output from the light emission controller 10, and the transistor 11 changes the current supplied to the light emitting portion 71 in accordance with a charged potential of the capacitor 12. In this way, the duty ratio of the PWM signal changes the potential of the capacitor 12. Then, the duty ratio of the PWM signal is changed so that the transistor 11 can change the current supplied to the light emitting portion 71. Therefore, using the PWM signal, it is possible to adjust the light emission intensity of the light emitting portion 71 (current supplied to the light emitting portion 71) step by step.

In addition, the image forming apparatus (printer 100) includes the above-mentioned fullness detection device 1. In other words, the image forming apparatus includes the fullness detection device 1 for controlling the light emitting portion 71 to emit light at minimum necessary light intensity in the fullness detection of the waste toner container 5. In this way, it is possible to provide the image forming apparatus without wasteful power consumption in which the light emitting element of the light emitting portion 71 has a long life with little failure. In addition, it is possible to provide the image forming apparatus in which it is checked that the waste toner container 5 is not full while current supplied to the light emitting portion 71 is increased step by step, so that the detection of whether or not the waste toner container 5 is full is performed accurately.

(Second Embodiment)

Figure 10:
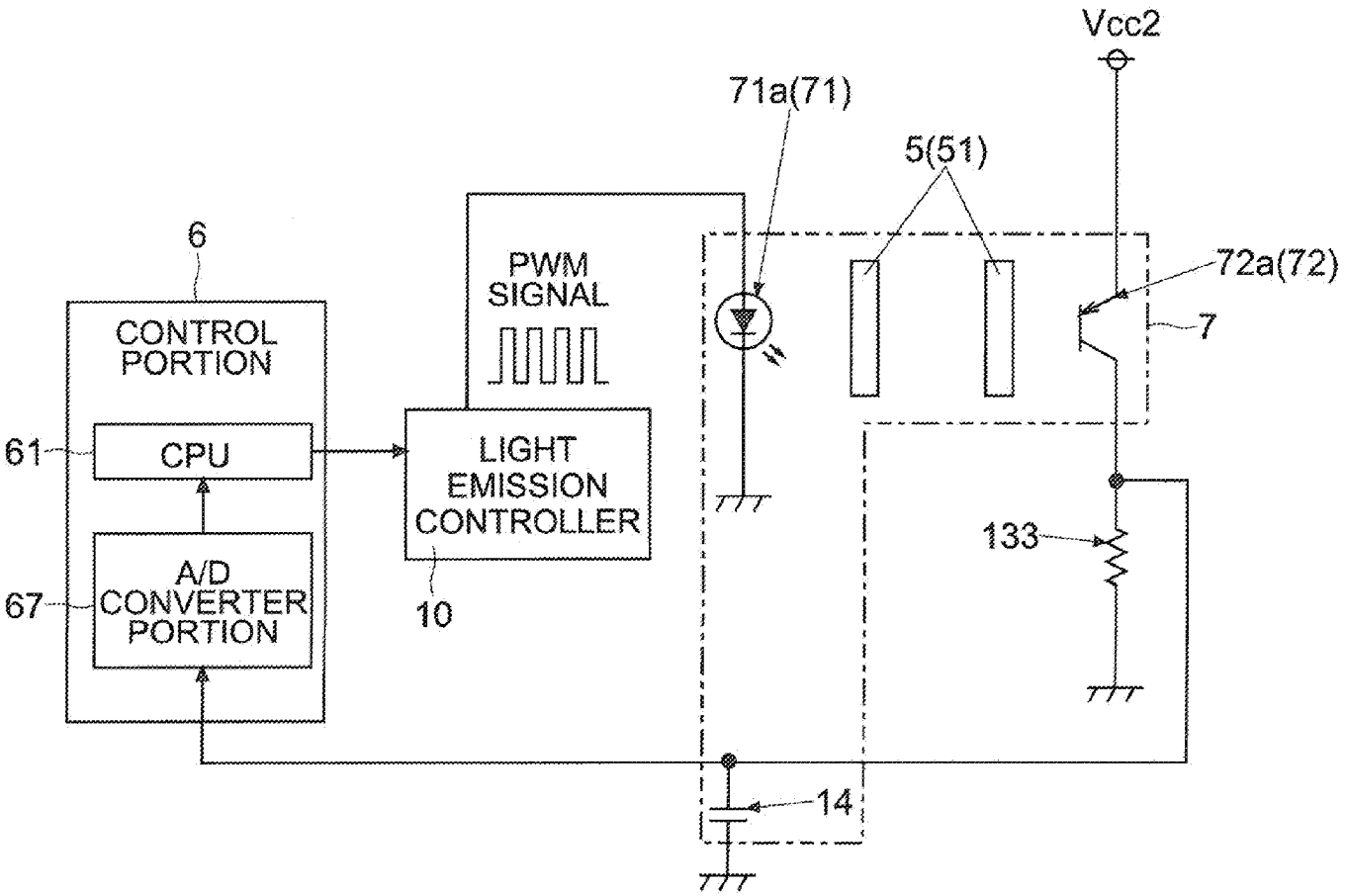
FIG. 10 is a circuit diagram of a fullness detection device according to a second embodiment.

Next, with reference to FIG. 10, the fullness detection device 1 and the printer 100 according to a second embodiment are described.

A circuit structure of the fullness detection device 1 according to the second embodiment is partly different from that of the first embodiment. However, other parts such as the structure of the printer 100, the flow (control) of the fullness detection can be the same as those of the first embodiment. Therefore, description and illustration of the same parts as the first embodiment are omitted unless otherwise noted.

The printer 100 of this embodiment also includes the fullness detection device 1. The fullness detection device 1 includes the waste toner container 5, the waste toner collecting portion, the optical sensor 7, the control portion 6, the light emission controller 10, and the storage portion 62 in the same manner as the first embodiment.

In this embodiment, the anode of the LED 71*a* as the light emitting portion 71 is connected to the light emission controller 10. Further, the cathode of the LED 71*a* is connected to the ground. Therefore, the PWM signal generated by the light emission controller 10 is supplied directly to the LED 71*a*. In other words, the light emission controller 10 controls the light emitting portion 71 to emit light on the basis of the PWM signal generated by itself. Note that the light emitting portion 71 (LED 71*a*) repeats on and off in accordance with a frequency and a duty ratio of the PWM signal when the duty ratio of the PWM signal is not 100%.

When the waste toner container 5 is not full, light generated by the light emitting portion 71 (LED 71*a*) passes through the waste toner container 5 and reaches the light receiving portion 72. As the light receiving portion 72, it is possible to use the phototransistor 72*a* in this embodiment, too.

Further, as illustrated in FIG. 10, the phototransistor 72*a* is a pnp type in this embodiment, too. The collector of the phototransistor 72*a* is connected to the power supply Vcc2. The constant DC voltage applied from the power supply Vcc2 is generated by the power supply device 65 disposed in the printer 100. In addition, the emitter of the phototransistor 72*a* is connected to a ground via the resistor 133.

The voltage between the emitter of the phototransistor 72*a* and the resistor 133 is supplied to the control portion 6 as an output of the light receiving portion 72. Here, unlike the first embodiment, a capacitor 14 (a part of the detecting portion) is connected to a line for supplying the output of the phototransistor 72*a* to the control portion 6. Further, the other end of the capacitor 14 is connected to the ground. When the light emitting portion 71 repeats on and off by the PWM signal, the light receiving portion 72 (phototransistor 72*a*) also repeats on and off. Therefore, the output value of the phototransistor 72*a* also changes intermittently. Therefore, as changing in accordance with on and off of the light receiving portion 72 (as current flowing in the phototransistor 72*a* changes), the capacitor 14 is charged by the output of the light receiving portion 72. In other words, the capacitor 14 smoothes the output value of the light receiving portion 72.

The voltage charged in the capacitor 14 is supplied to the control portion 6. The potential of the capacitor 14 changes in accordance with light intensity received by the light receiving portion 72 per unit time. Specifically, as the duty ratio of the PWM signal becomes larger (as the on-time of the light receiving portion 72 becomes longer), the potential of the capacitor 14 becomes higher. In other words, as the light intensity (light emission level) of the light emitting portion 71 (LED 71*a*) per unit time becomes larger, the potential of the capacitor 14 becomes higher. On the contrary, as the duty ratio of the PWM signal becomes smaller (as the off-time of the light receiving portion 72 becomes longer), the potential of the capacitor 14 becomes lower. In other words, as the light intensity (light emission level) of the light emitting portion 71 (LED 71*a*) per unit time becomes smaller, the potential of the capacitor 14 becomes lower.

In this way, the potential of the capacitor 14 changes in accordance with the current flowing in the light emitting portion 71. Here, the light emission controller 10 generates the PWM signal. Therefore, in order to increase the light intensity of the LED 71*a* per unit time, the light emission controller 10 increases the on-duty time of the PWM signal (increases the duty ratio). In this way, the current flowing in the LED 71*a* per unit time increases so that the light intensity of the LED 71*a* is increased. Then, the potential of the capacitor 14 is raised. On the contrary, in order to decrease the light intensity of the LED 71*a* per unit time, the light emission controller 10 decreases the on-duty time of the PWM signal (decreases the duty ratio). In this way, the current flowing in the LED 71*a* per unit time decreases so that the light intensity of the LED 71*a* is decreased. Then, the potential of the capacitor 14 is decreased.

Here, also in this embodiment, the light emission controller 10 can change the duty ratio (on-duty time) step by step. For instance, the light emission controller 10 can change the duty ratio by step of 1% (or by step of a few percent, or by step of 10%). In this way, the light emission controller 10 can change the duty ratio in a plurality of levels (steps). In this way, the light emission controller 10 changes the duty ratio of the PWM signal step by step (changes the duty ratio by a predetermined step) on the basis of an instruction of the control portion 6, so as to increase the light intensity of the light emitting portion 71 by a predetermined amount. When the duty ratio is changed, the potential of the capacitor 14 is changed when the waste toner container 5 is not full.

Then, the output value of the light receiving portion 72 charged by the capacitor 14 is supplied to the A/D converter portion 67 of the control portion 6. The A/D converter portion 67 performs analog to digital conversion of the output of the light receiving portion 72 and delivers a digital value indicating the output of the light receiving portion 72 to the CPU 61. Further, when the CPU 61 includes an A/D conversion process circuit, the CPU 61 can perform the A/D conversion process without the A/D converter portion 67. Then, the CPU 61 recognizes the output value of the light receiving portion 72. In addition, the control portion 6 can recognize whether or not the output value of the light receiving portion 72 is higher than a predetermined threshold value.

When the waste toner container 5 is not full, the light intensity of the light emitting portion 71 (LED 71*a*) becomes higher as the duty ratio of the PWM signal becomes larger. Therefore, the output value (output voltage) of the light receiving portion 72 (phototransistor 72*a*) charged by the capacitor 14 becomes larger. On the contrary, as the duty ratio of the PWM signal becomes smaller, the light intensity of the light emitting portion 71 (LED 71*a*) becomes lower. Therefore, the output value (output voltage) of the light receiving portion 72 (phototransistor 72*a*) charged by the capacitor 14 becomes lower. In addition, even when the light emitting portion 71 is turned on when the waste toner container 5 is full, the output value of the light receiving portion 72 charged by the capacitor 14 becomes approximately zero because the waste toner T interrupts light. Therefore, even when the duty ratio is changed, the output value is not changed.

In this way, in the fullness detection device 1 of this embodiment, the light emitting portion 71 emits light on the basis of the PWM signal output from the light emission controller 10, the detecting portion (optical sensor 7) includes the capacitor 14 connected to the line for supplying the output of the light receiving portion 72 to the determining portion (control portion 6), and the capacitor 14 is charged by the output of the light receiving portion 72. In this way, the potential of the capacitor 14 for charging the output of the light receiving portion 72 changes in accordance with the on-duty time of the PWM signal. Therefore, the output level of the light receiving portion 72 supplied to the determining portion is changed in accordance with on-duty time of the PWM signal. Further, even when the light emitting portion 71 is controlled to repeat on and off intermittently by the PWM signal, the determining portion can accurately recognize the output level (output value) of the light receiving portion 72.

Next, other embodiments of the fullness detection device 1 and the image forming apparatus are described. In the above description, the black and white printer 100 is exemplified. However, the fullness detection device 1 of this embodiment can be applied to a color image forming apparatus using a plurality of color toners for printing. In addition, in case of the color image forming apparatus, an intermediate transfer belt may be used for overlaying individual color toner images, and the cleaning device 4 may be disposed for collecting residual toner and the like on the intermediate transfer belt. Therefore, it is possible to dispose the above-mentioned fullness detection device 1 for the waste toner container 5 for collecting and storing the waste toner T on the intermediate transfer belt.

In addition, in the above-mentioned embodiment, there is described the case where the light intensity of the light emitting portion 71 is changed step by step using the PWM signal. However, it is possible to adjust the light intensity of the light emitting portion 71 by changing not the PWM signal but a voltage (current) applied to the light emitting portion 71 (LED 71*a*). In this case, the control portion 6 or the light emission controller 10 adjusts the voltage applied to the light emitting portion 71 (current supplied to the light emitting portion 71), so as to adjust the light intensity of the light emitting portion 71.

Although the embodiments of the present disclosure are described above, the present disclosure can be embodied as a method.

Although the embodiments of the present disclosure are described above, the scope of the present disclosure is not limited to the embodiments. It is possible to embody the disclosure with various modifications within the scope without deviating from the spirit thereof.

What is claimed is:

1. A fullness detection device comprising:

a waste toner collecting portion configured to collect waste toner;

a waste toner container configured to store the waste toner collected by the waste toner collecting portion, the waste toner container has translucency;

a detecting portion including a light emitting portion and a light receiving portion disposed to sandwich the waste toner container, the light emitting portion emitting light to the light receiving portion when a predetermined timing of performing fullness detection of the waste toner container comes, the light receiving portion receiving the light from the light emitting portion so as to output different values depending on received light intensity;

a determining portion configured to determine whether or not the waste toner container is full based on whether or not output value of the light receiving portion is higher than a predetermined threshold value;

a storage portion configured to store the level at which it was determined that the waste toner container was not full in the last fullness detection; and a light emission controller configured to increase light intensity of the light emitting portion step by step in the fullness detection and for controlling the light emitting portion to emit light at a level of smallest light intensity among light intensity levels at which the determining portion can determine that the waste toner container is not full wherein the light emitting portion starts light emission at light intensity of the level stored in the storage portion when the timing of performing the fullness detection of the waste toner container comes, and on determining that the waste toner container is full, the determining portion stores, in the storage portion, data for controlling the light emitting portion to emit light at minimum light intensity such that the light intensity of the light emitting portion is reset to be minimum.

2. The fullness detection device according to claim 1, wherein the light emission controller changes the light intensity of the light emitting portion step by step until the determining portion determines that the waste toner container is not full, and the determining portion determines that the waste toner container is full when the output value of the light receiving portion is the threshold value or lower even when the light emitting portion emits light at permissible maximum light intensity.

3. The fullness detection device according to claim 1, wherein the light emitting portion starts light emission at a light intensity of a predetermined minimum level when the timing of performing the fullness detection of the waste toner container comes.

4. The fullness detection device according to claim 1, wherein the light emission controller outputs a PWM signal as a signal for controlling the light intensity of the light emitting portion, the light emitting portion changes a duty ratio of the PWM signal step by step, so as to change the light intensity step by step, and the determining portion stores in the storage portion, as data indicating the level at which it was determined that the waste toner container was not full, the duty ratio of the PWM signal when it was determined that the waste toner container was not full.

5. The fullness detection device according to claim 4, wherein the detecting portion includes a transistor for adjusting current to the light emitting portion, and a capacitor connected to a line connecting the transistor with the light emission controller, the capacitor is charged by the PWM signal output from the light emission controller, and the transistor changes current supplied to the light emitting portion in accordance with potential of the charged capacitor.

6. The fullness detection device according to claim 4, wherein the light emitting portion emits light on the basis of the PWM signal output from the light emission controller, the detecting portion includes a capacitor connected to a line for supplying an output of the light receiving portion to the determining portion, and the capacitor is charged by the output of the light receiving portion.

7. An image forming apparatus comprising a fullness detection device wherein a waste toner collecting portion configured to collect waste toner;

a waste toner container configured to store the waste toner collected by the waste toner collecting portion, the waste toner container has translucency;

a detecting portion including a light emitting portion and a light receiving portion disposed to sandwich the waste toner container, the light emitting portion emitting light to the light receiving portion when a predetermined timing of performing fullness detection of the waste toner container comes, the light receiving portion receiving the light from the light emitting portion so as to output different values depending on received light intensity;

a determining portion configured to determine whether or not the waste toner container is full based on whether or not output value of the light receiving portion is higher than a predetermined threshold value;

a storage portion configured to store the level at which it was determined that the waste toner container was not full in the last fullness detection; and a light emission controller configured to increase light intensity of the light emitting portion step by step in the fullness detection and for controlling the light emitting portion to emit light at a level of smallest light intensity among light intensity levels at which the determining portion can determine that the waste toner container is not full wherein the light emitting portion starts light emission at light intensity of the level stored in the storage portion when the timing of performing the fullness detection of the waste toner container comes, and on determining that the waste toner container is full, the determining portion stores, in the storage portion, data for controlling the light emitting portion to emit light at minimum light intensity such that the light intensity of the light emitting portion is reset to be minimum.

8. A method for controlling a fullness detection device, the method comprising the steps of:

collecting waste toner;

storing the collected waste toner in a waste toner container has translucency;

disposing a light emitting portion and a light receiving portion to sandwich the waste toner container, so that the light receiving portion receives light from the light emitting portion and outputs difference values depending on received light intensity;

increasing light intensity of the light emitting portion step by step when a predetermined timing of performing the fullness detection of the waste toner container comes;

determining whether or not the waste toner container is full based on whether or not an output value of the light receiving portion is higher than a predetermined threshold value;

performing the fullness detection at a level of smallest light intensity among light intensity levels at which it is determined that the waste toner container is not full;

storing the level at which it was determined that the waste toner container was not full in the last fullness detection; and starting light emission of the light emitting portion at light intensity of the stored level when the timing of performing the fullness detection of the waste toner container comes.

9. The method for controlling a fullness detection device according to claim 8, further comprising the steps of:

changing the light intensity of the light emitting portion step by step until it is determined by a determining portion that the waste toner container is not full; and determining that the waste toner container is full when the output value of the light receiving portion is the threshold value or lower even when the light emitting portion emits light at permissible maximum light intensity.

10. The method for controlling a fullness detection device according to claim 8, further comprising the step of starting light emission of the light emitting portion at a light intensity of a predetermined minimum level when the timing of performing the fullness detection of the waste toner container comes.

11. A method for controlling the fullness detection device recited in claim 1, the method comprising the steps of:

disposing a light emission controller for outputting a PWM signal as a signal for controlling the light intensity of the light emitting portion;

changing a duty ratio of the PWM signal step by step, so as to change the light intensity of the light emitting portion step by step; and storing in the storage portion, as data indicating the level at which it was determined that the waste toner container was not full, the duty ratio of the PWM signal when it was determined that the waste toner container was not full.

12. The method for controlling a fullness detection device according to claim 11, further comprising the steps of:

adjusting current of the light emitting portion by a transistor;

charging a capacitor connected to a line connecting the transistor with the light emission controller by the PWM signal output from the light emission controller; and controlling the transistor to change current supplied to the light emitting portion in accordance with potential of the charged capacitor.

13. The method for controlling a fullness detection device according to claim 11, further comprising the steps of:

controlling the light emitting portion to emit light on the basis of the PWM signal output from the light emission controller;

connecting a capacitor to an output line of the light receiving portion; and charging the capacitor by an output of the light receiving portion.

* * * * *